US008136321B1

(12) United States Patent
Bauman

(10) Patent No.: US 8,136,321 B1
(45) Date of Patent: Mar. 20, 2012

(54) DECORATIVE CEILING/WALL PANEL

(76) Inventor: Jeffrey Bauman, Palmetto, FL (US)

( * ) Notice: Subject to any disclaimer, the term of this patent is extended or adjusted under 35 U.S.C. 154(b) by 0 days.

(21) Appl. No.: 13/050,243

(22) Filed: Mar. 17, 2011

(51) Int. Cl.
*E04B 2/00* (2006.01)
*E04B 5/00* (2006.01)
*E04B 9/00* (2006.01)

(52) U.S. Cl. ..... 52/506.08; 52/462; 52/463; 52/468; 52/506.05

(58) Field of Classification Search ..... 52/506.06, 52/506.08, 506.09, 506.05, 506.1, 588.1, 52/462, 463, 464, 468, 478, 483.1, 520, 546, 52/548
See application file for complete search history.

(56) References Cited

U.S. PATENT DOCUMENTS

| | | | | | |
|---|---|---|---|---|---|
| 460,283 | A | | 9/1891 | Adler | |
| 3,314,203 | A | * | 4/1967 | Hill et al. | 52/288.1 |
| 3,797,190 | A | | 3/1974 | Widdowson | |
| 3,868,802 | A | * | 3/1975 | Schubach | 52/462 |
| 4,228,629 | A | * | 10/1980 | Chalmers et al. | 52/460 |
| 4,437,287 | A | | 3/1984 | Halfaker | |
| 4,936,065 | A | * | 6/1990 | Hutchinson | 52/235 |
| 4,962,612 | A | * | 10/1990 | Kuwano et al. | 52/506.06 |
| 4,987,715 | A | * | 1/1991 | Dunn | 52/506.08 |
| 5,191,743 | A | | 3/1993 | Gailey | |
| 5,425,210 | A | | 6/1995 | Zafir | |
| 5,809,709 | A | * | 9/1998 | Ryan et al. | 52/222 |
| 6,117,514 | A | | 9/2000 | Herrmann | |
| 6,723,419 | B2 | | 4/2004 | Rogers | |
| 7,134,249 | B2 | | 11/2006 | Shapiro et al. | |
| 2007/0011975 | A1 | | 1/2007 | Shapiro | |
| 2008/0060318 | A1 | | 3/2008 | Schaffeld | |
| 2009/0183458 | A1 | | 7/2009 | Gibson et al. | |

* cited by examiner

*Primary Examiner* — Brian Glessner
*Assistant Examiner* — Brian D Mattei
(74) *Attorney, Agent, or Firm* — Charles J. Prescott

(57) ABSTRACT

A decorative panel for installation on a ceiling or wall as part of a grid of panels. Each of the panels includes a formed sheet of thin sheet metal or plastic material having a main decorative portion and side edges forming a perimeter of the panel. Each side edge includes a flange offset from and extending outwardly from the main decorative portion and a groove positioned between the decorative portion and the flange. Each flange in the grid capable of overlapping the next adjacent flange and to receive a fastener through both overlapping flanges to secure the panels against the ceiling or wall. Adjacent side edges define a gap therebetween into which a resilient concealment strip having flexible sides is resiliently securable into the gap to conceal the fasteners.

3 Claims, 9 Drawing Sheets

DECORATIVE CEILING/WALL PANEL

CROSS-REFERENCE TO RELATED APPLICATIONS

Not applicable

STATEMENT REGARDING FEDERALLY SPONSORED RESEARCH OR DEVELOPMENT

Not applicable

INCORPORATION-BY-REFERENCE OF MATERIAL SUBMITTED ON A COMPACT DISC

Not applicable

BACKGROUND OF THE INVENTION

1. Field of the Invention

This invention relates generally to ceiling and wall panels, and more particularly to ceiling panels made of thin material having a decorative main portion and side margins capable of being attached directly onto a ceiling or wall surface wherein the attaching fasteners are concealed from view.

2. Description of Related Art

Ceiling tiles and panels are used extensively to add decorative accents, noise absorption and remodeling aspects to both new and existing buildings and homes. Such panels may be attached to the ceiling or wall surface by a mechanical fastening, adhesives, or metal hung framework into which the ceiling panels will be supported.

Many known prior art patented devices and systems are known to offer various functional and aesthetic aspects to an interior ceiling or wall panel.

U.S. Pat. No. 460,283 to Adler discloses a metallic ceiling. Shapiro et al. teach a ceiling panel for installation as a component of a matrix grid of similar panels which are capable of being installed directly on sheetrock ceilings in U.S. Pat. No. 7,134,249.

A decorative ceiling panel to be placed over and directly attached to an existing ceiling or wall surface is also disclosed by Shapiro in U.S. Patent Application Publication 2007/0011975. Herrmann teaches a lightweight and interlocking plastic ceiling tile system in U.S. Pat. No. 6,117,514.

A ceiling panel is taught by Halfaker in U.S. Pat. No. 4,437,287. U.S. Pat. No. 5,425,210 to Zafir discloses a composite insulated building panel.

A concealing trim assembly for a wall or ceiling panel system is taught by Gailey in U.S. Pat. No. 5,191,743. Widdowson teaches a prefabricated, insulated, metal wall panel in U.S. Pat. No. 3,797,190.

The present invention provides a very thin thickness decorative panel, preferably of uniform thickness, formed of preferably metal but alternately thin molded plastic material which affords a large main decorative portion suitable for implementing virtually any design aspect left to the imagination, but also providing for easy installation by the use of mechanical fasteners such as screws, nails or staples, after which the gaps formed between these raised decorative panels receive an elongated concealment strip secured within those gaps to completely conceal those fasteners. Moreover, the side edges of each panel include flanges, which, when installed, one panel adjacent to another, overlap so as to minimize the number of fasteners needed to secure each of the decorative panels onto a working surface such as a ceiling or wall.

The foregoing examples of the related art and limitations related therewith are intended to be illustrative and not exclusive. Other limitations of the related art will become apparent to those skilled in the art upon a reading of the specification and a study of the drawings.

BRIEF SUMMARY OF THE INVENTION

This invention is directed to a decorative panel for installation on a ceiling or wall as part of a grid of panels. Each of the panels includes a formed sheet of thin sheet metal or plastic material having a main decorative portion and side edges forming a perimeter of the panel. Each side edge includes a flange offset from and extending outwardly from the main decorative portion and a groove positioned between the decorative portion and the flange. Each flange in the grid capable of overlapping the next adjacent flange and to receive a fastener through both overlapping flanges to secure the panels against the ceiling or wall. Adjacent side edges define a gap therebetween into which a resilient concealment strip having flexible sides is resiliently securable into the gap to conceal the fasteners.

It is therefore an object of this invention to provide a decorative ceiling panel for installation onto a wall or ceiling as part a grid of such panels, which panels include a main decorative portion having any desired design formed thereon to enhance the overall appearance of such working surfaces.

Still another object of this invention is to provide a decorative panel formed of thin, preferably uniform thickness material such as metal or plastic having overlapping flanges along the side edges of each panel which overlap one another in adjacent side-by-side fashion to minimize the number of fasteners needed to securely install a grid onto a working surface such as a ceiling or wall.

Yet another object of this invention is to provide a decorative panel for installation onto a working surface as part of a grid which fully conceals the mechanical fasteners utilized to attach the grid to the working surface.

The following embodiments and aspects thereof are described and illustrated in conjunction with systems, tools and methods which are meant to be exemplary and illustrative and not limiting in scope. In various embodiments one or more of the above-described problems have been reduced or eliminated while other embodiments are directed to other improvements. In addition to the exemplary aspects and embodiments described above, further aspects and embodiments will become apparent by reference to the drawings and by study of the following descriptions.

BRIEF DESCRIPTION OF THE SEVERAL VIEWS OF THE DRAWING(S)

Figure 1:
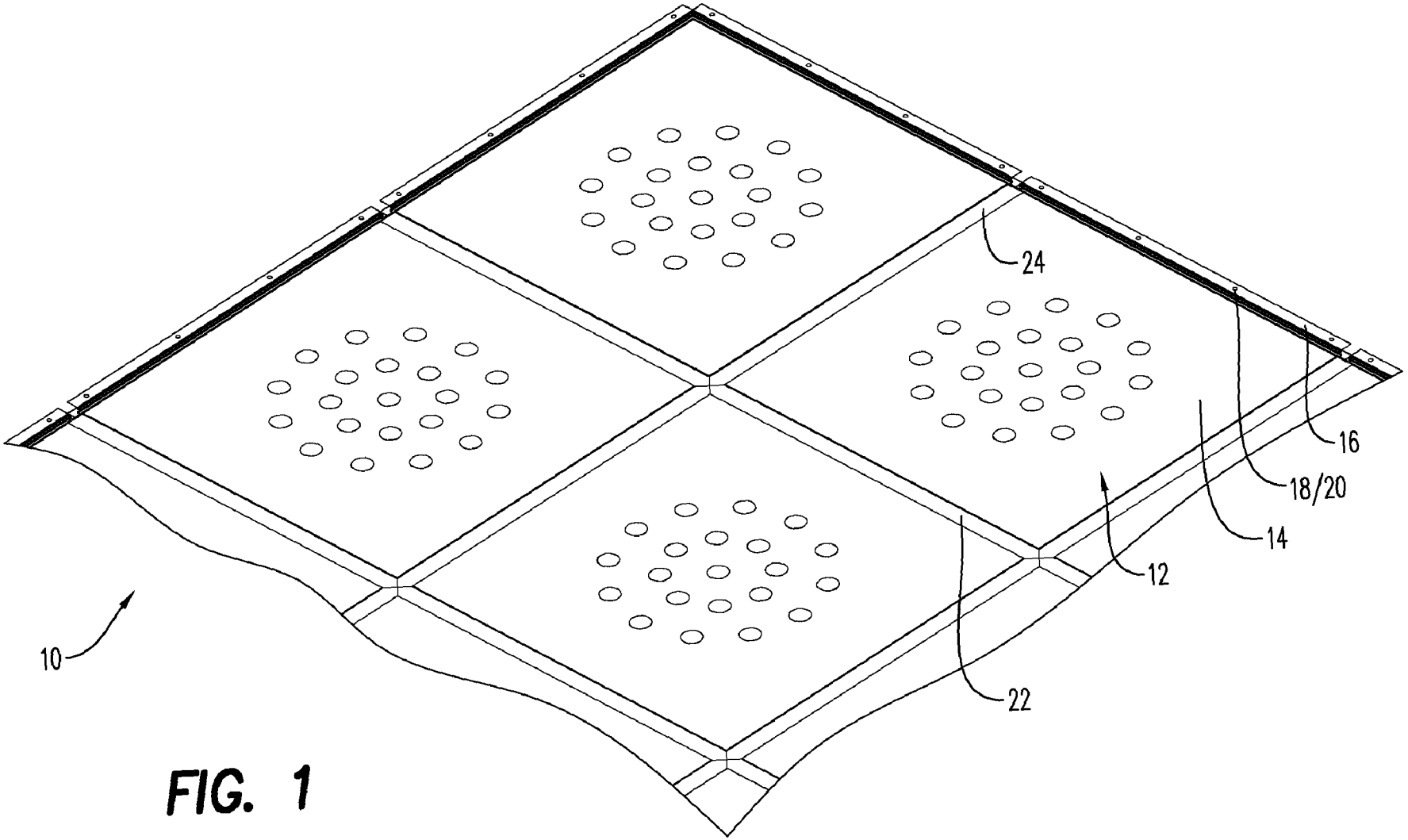
FIG. 1 is a perspective view of a corner portion of a grid attached to a ceiling utilizing the decorative panels of this invention.

Exemplary embodiments are illustrated in reference figures of the drawings. It is intended that the embodiments and figures disclosed herein are to be considered to be illustrative rather than limiting.

DETAILED DESCRIPTION OF THE INVENTION

Referring now to the drawings, a corner area of a grid formed of a plurality of adjacent connected together decorative panels 12 is shown generally at numeral 10. Each of these decorative panels 12 are secured to a ceiling by fasteners 20, typically sheetrock type screws, which pass through aligned apertures 18 formed in spaced apart relationship through flange 16 which extends around all side margins of a decorative central or main portion 14 of each decorative panel 12. As will be described in more detail herebelow, after each of the decorative panels 12 is anchored in closely aligned adjacent spatial relationship to the next adjacent panel 12 and secured in place by fasteners 20, a concealment strip 22 or 24 is resiliently secured in the direction of arrow A in FIG. 2 into a gap 50 formed between opposing side edges 52 of adjacent panels.

Figure 4A:
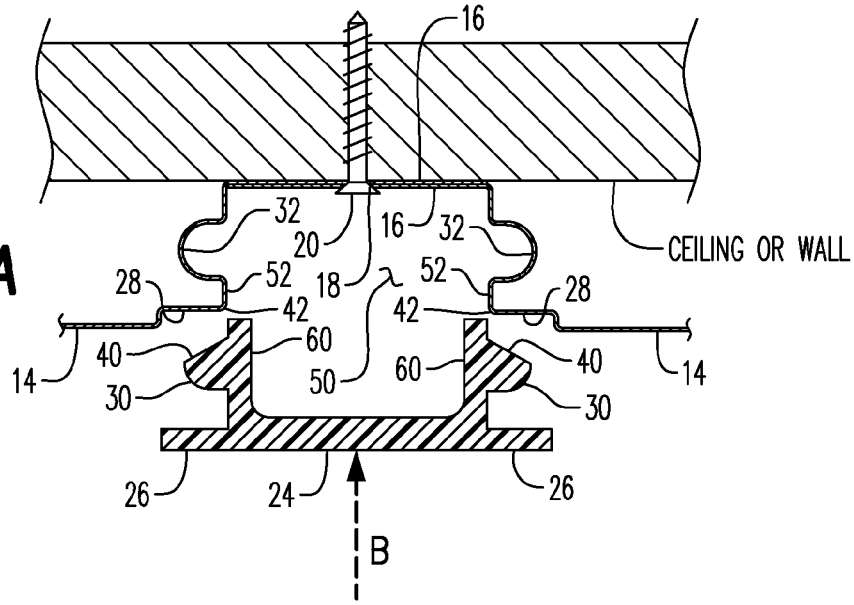
FIGS. 4A, 4B and 4C are section views in the direction of arrows 4-4 in FIG. 3 depicting the sequence of concealment strip installation.
Figure 4B:
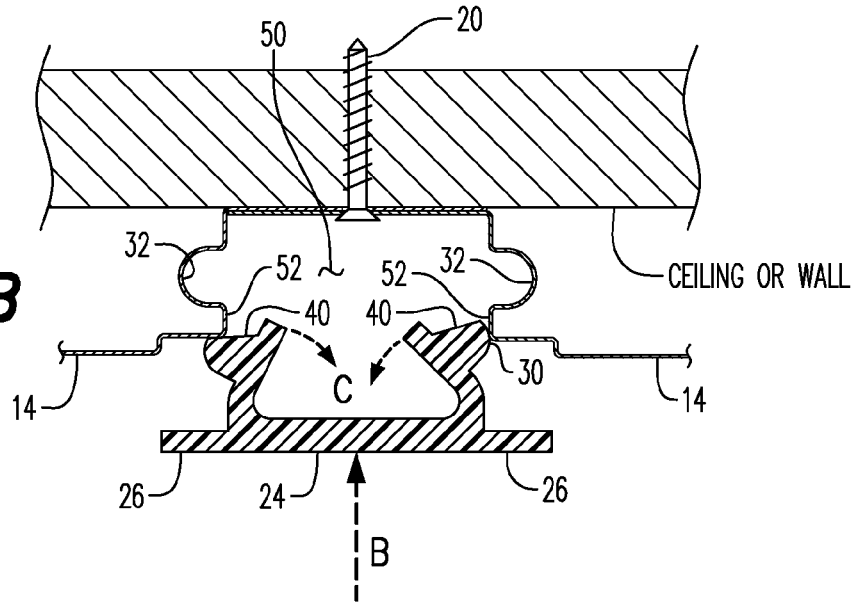
Figure 4C:
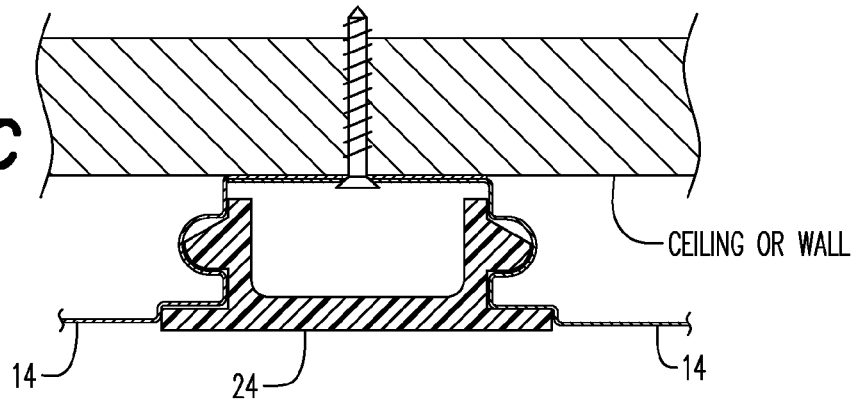
Figure 6:
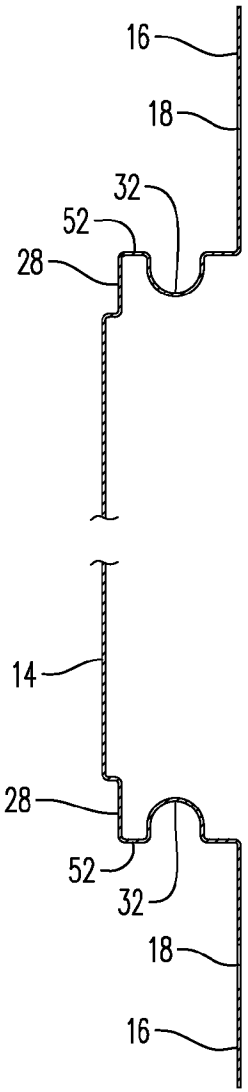
FIG. 6 is a section view in the direction of arrows 6-6 in FIG. 5.
Figure 5:
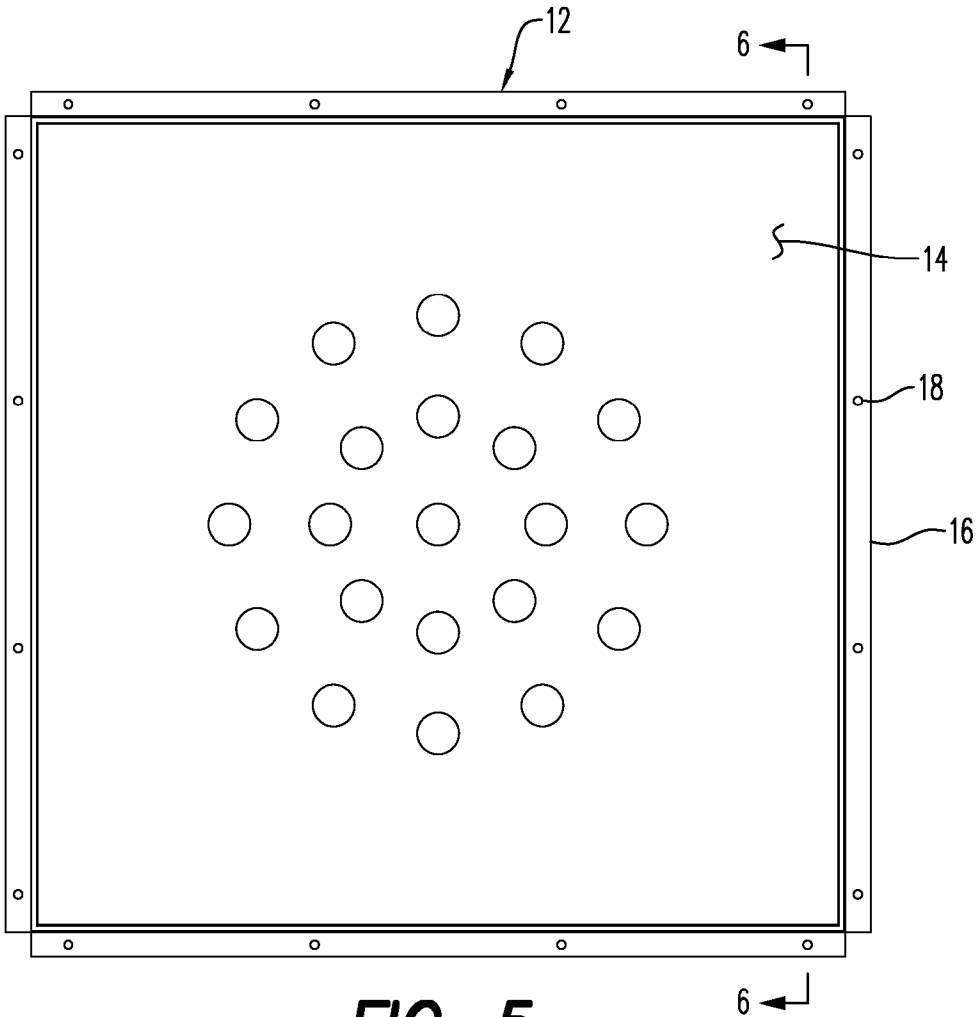
FIG. 5 is a plan view of one of the decorative panels of FIG. 1.

As particularly seen in FIGS. 4 to 6, each of the decorative panels 12 is formed preferably as a unit of a single sheet thin metal material having a thickness preferably in the range of 0.0085" to 0.0105" having a main decorative portion 14 bearing any desired formed or applied design subject only to the artistic imagination. Alternately, the decorative panel also may be formed of thin molded thermoplastic material. In its preferred rectangular embodiment of a approximately 24"× 24", each decorative panel 12 also includes formed side edges 52 which include a flat flange 16 offset from the plane of the main decorative portion 14 and lying in a plane parallel thereto. Each flange 16 outwardly extends away from the main decorative portion 14, the length of each flange 16 preferably being 0.75".

Still particularly referring to FIGS. 4 to 6, each side edge 52 of each panel 12 also includes a groove 32 formed inwardly of the side edges and positioned between the main decorative portion 14 and the flange 16. Each groove 32 preferably is defined having a generally offset semicircular cross-section of radius 0.075" and a depth of 0.12". Each side edge 52 further includes a recess 28 offset from the flange 14 a length approximately 0.19" and a depth of approximately 0.05".

In constructing a grid 10 of closely aligned adjacent decorative panels 12, as best seen in FIG. 4, the flanges 16 of adjacent panels 12 are brought together in overlapping alignment one to another with preformed fastener apertures 18 aligned with one another. The preferred spacing between each of these apertures 18 is 7.25". When all of the apertures 18 are so aligned laterally as well as in spatial relationship so that distal edges of each of the flanges 16 abut against the opposing side edges 52 of the next adjacent panel 12, the fasteners 20 are secured into the ceiling or wall structure.

Figure 2:
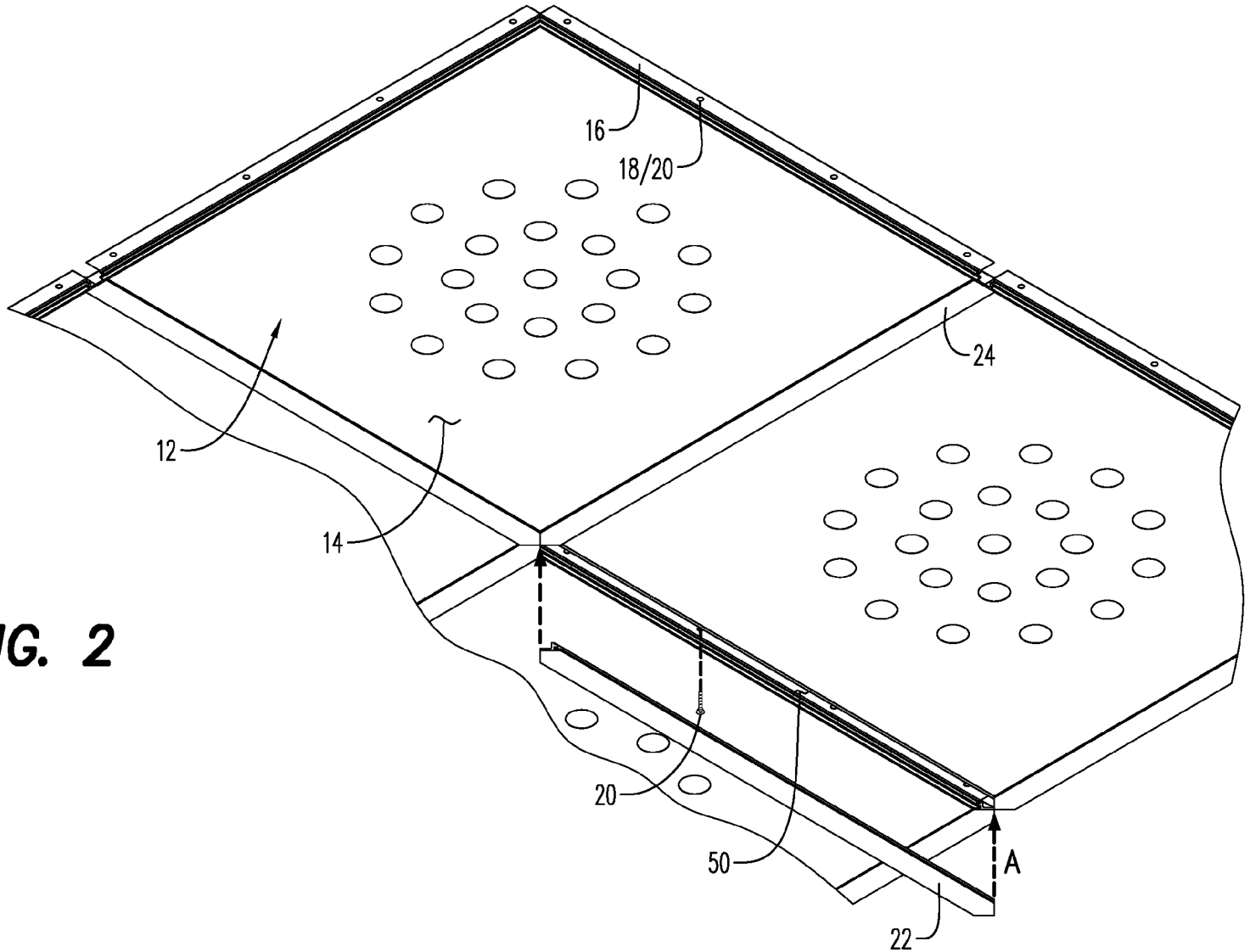
FIG. 2 is an enlarged portion of FIG. 1 showing one of the resilient concealment strips in exploded view.
Figure 3:
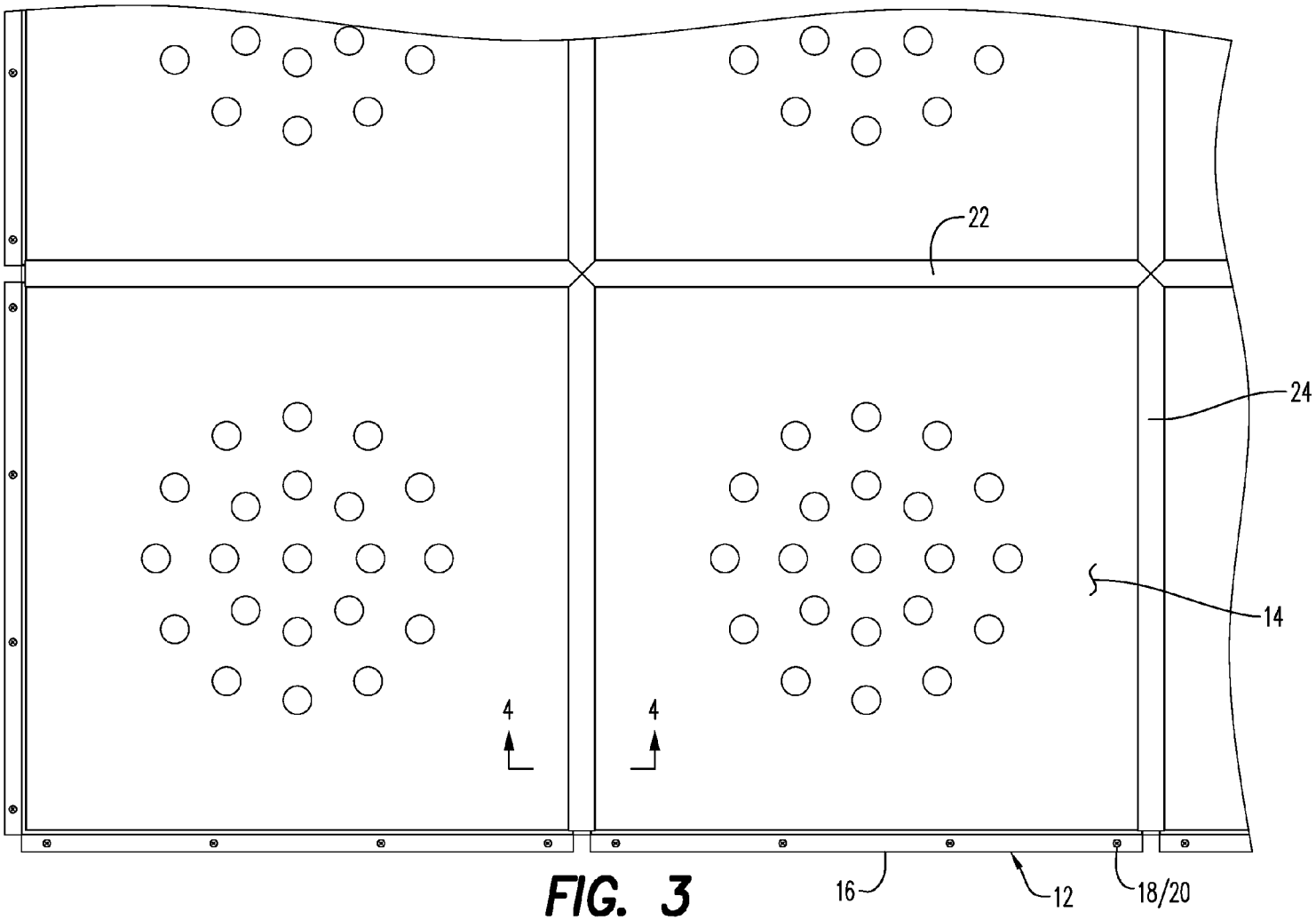
FIG. 3 is a plan view of a corner area of FIG. 1.

After all of the panels 12 have been secured to the wall or ceiling in a grid 10 shown in FIGS. 1, 2 and 3, each of the fasteners 20 secured through aligned apertures 18 in the flanges 16 remain visible. To conceal or hide the presence of the fasteners 20, elongated resilient concealment strips 22 and 24 are provided. Made of any suitable resilient plastic material, each of the concealment strips 22 and 24, the exposed lower surfaces 54 and 56 of the concealment strips 22 and 24, respectively, include outwardly extending flanges 36 and 26, respectively, and upright legs 58 and 60, respectively, of a generally U-shaped or π-shaped section, the legs 58 and 60 including outwardly extending beads 30 which are sized and contoured to fit into the formed grooves 32 of the side edges of each of the decorative panels 12 as previously described.

Figures 7A, 7B:
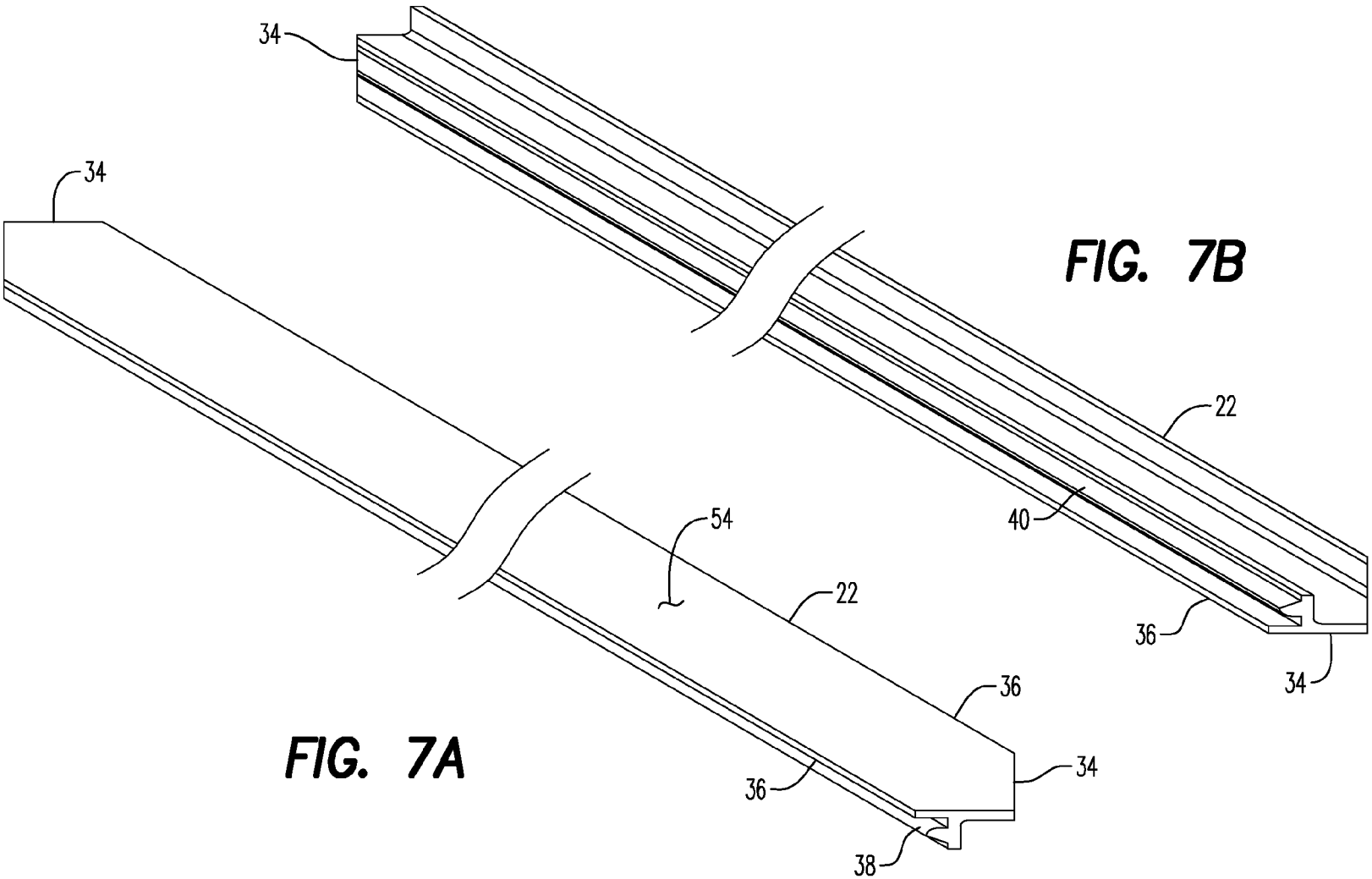
FIGS. 7A and 7B are perspective views of one embodiment of the concealment strip.
Figure 7C:
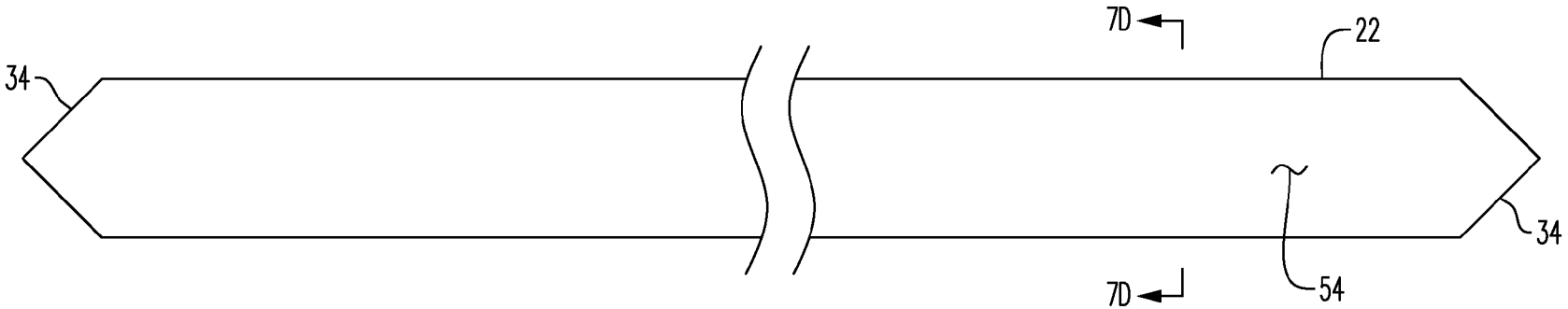
FIG. 7C is a top plan view of FIG. 7A.
Figure 7D:
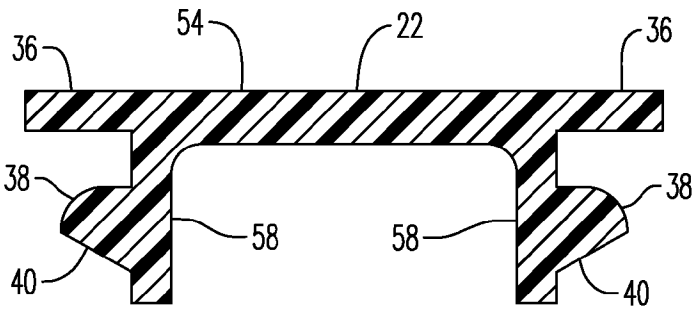
FIG. 7D is a section view in the direction of arrows 7D-7D in FIG. 7C.
Figures 8A, 8B:
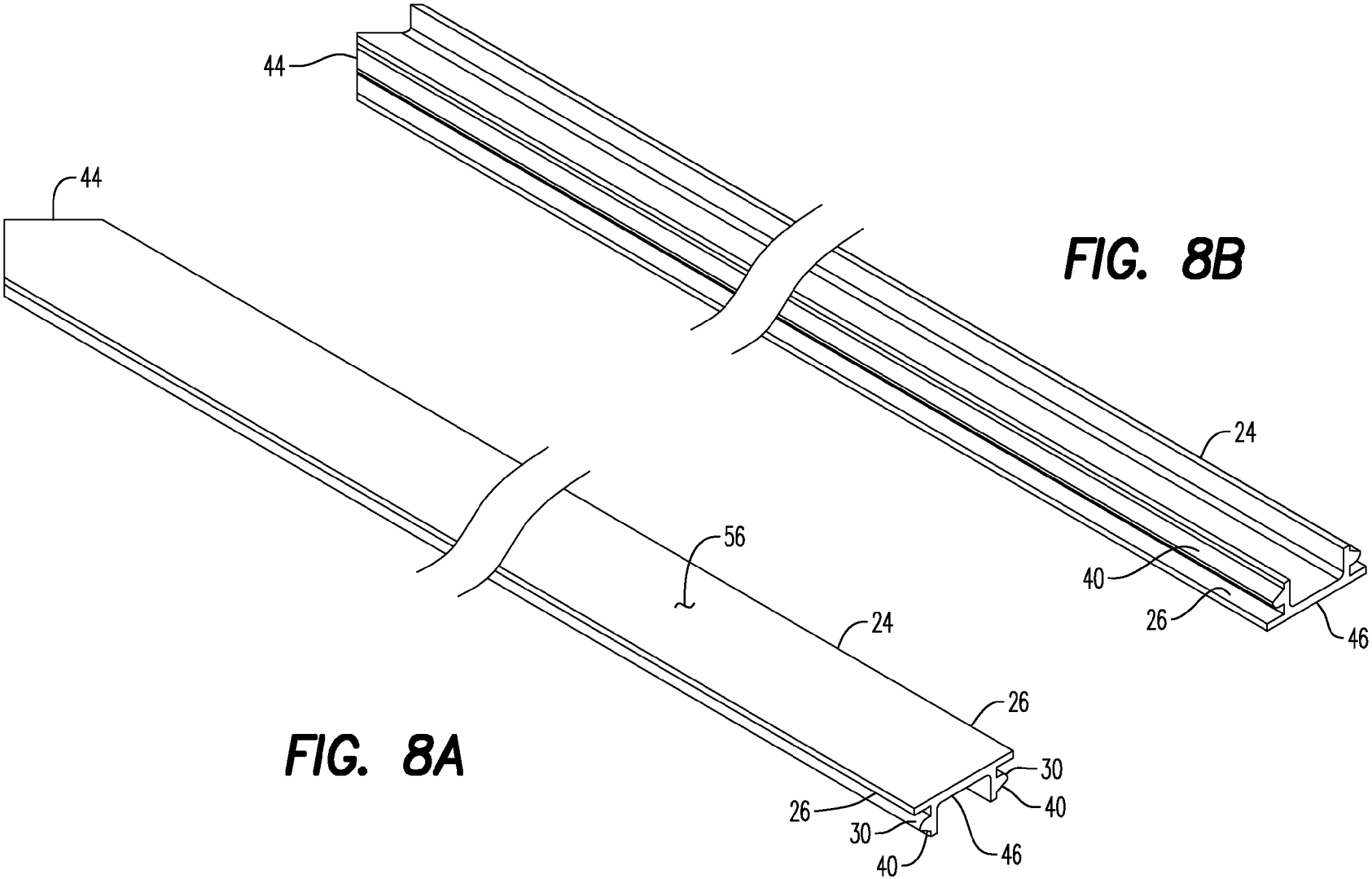
FIGS. 8A and 8B are perspective views of another embodiment of the concealment strip.
Figure 8C:
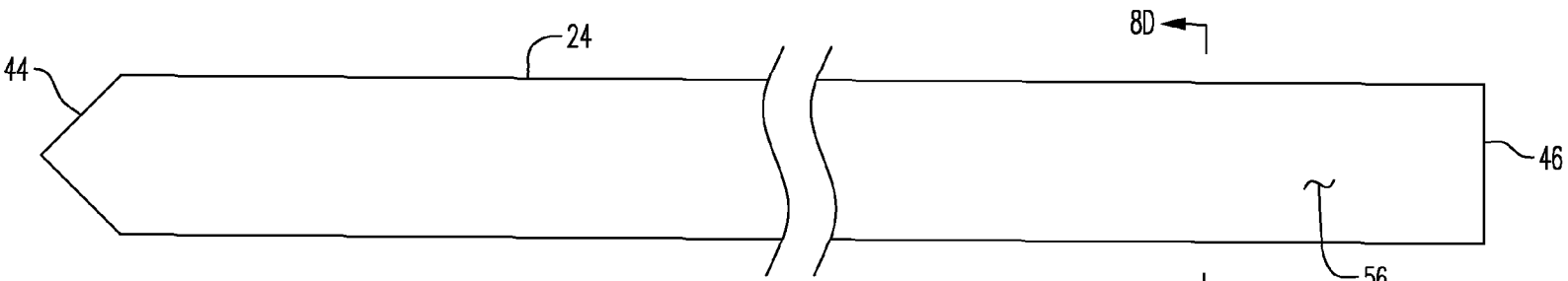
FIG. 8C is a plan view of the concealment strip of FIGS. 8A and 8B.
Figure 8D:
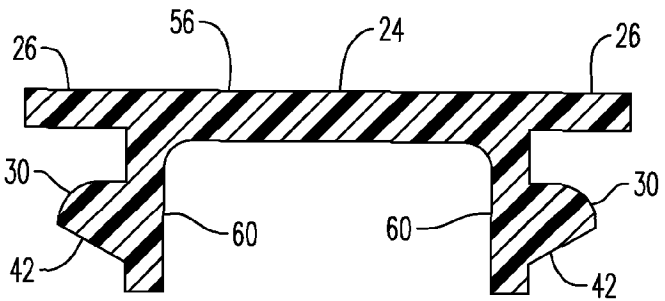
FIG. 8D is a section view if the direction of arrows 8D-8D in FIG. 8C.

To insert each of the concealment strips 24 into one of the gaps, as seen in FIG. 4A, the concealment strip is then moved in the direction of arrow B toward the gap 50. In FIG. 4B, each of the beads 30 (and 38 in FIG. 7D) includes a chamfered leading surface 40 (and 42) which move from the relaxed configuration of the concealment strip 24 in the direction of arrows C into a resiliently deformed inwardly deflected position by contact against the corners 42 of the side surfaces 60 (and 58). Inward deflection occurs in the direction of arrow C so as to allow the beads 30 (and 38) to pass into the gap 50. Further movement of the concealment strip 24 (and 22) in the direction of arrow B then positions the beads 30 (and 38) in alignment with the grooves 32 at which point the legs 60 (and 58) of the concealment strip 24 flex outwardly into tight secure alignment within the grooves 32 thus securing the concealment strip 24 (and 22) in place to conceal the fasteners 18. At the outer edges of each of the main decorative portions 14 are alignment cavities 28 which receive one of the flanges 26.

Referring additionally to FIGS. 7A to 7D, one embodiment of the concealment strip is shown at 22 which represents a middle or mid-strip which is positioned in the central portions of a grid of FIGS. 1 to 3 away from the outer margins of the grid 10. To facilitate this placement orientation, each of the ends 34 of this concealment strip 22 are symmetrically tapered at 45° so as to be precisely mateable with opposing and adjacent concealment strips at the corners of mating panels 12. These concealment strips 22 include the outwardly extending beads 38 and flanges 36 which matably fit into the alignment cavities 28 of each of the decorative panels 12.

In FIGS. 8A to 8D, the outermost positioned concealment strips 24 also have the same resilient cross-section formed of plastic material having beads 30 with chamfered leading surfaces 42 as previously described. However, one end 46 of this concealment strip 24 is squared off so as to be aligned with the outer edges of adjacent panels at the periphery of the grid 10. The inner end 44 is tapered symmetrically at 45° so as to mate with three of the ends 34 of the three converging concealment strips 22 to completely close the gaps 50, concealing the presence of all fasteners 20 holding the decorative panels 12 in place against the ceiling or wall.

While a number of exemplary aspects and embodiments have been discussed above, those of skill in the art will recognize certain modifications, permutations and additions and subcombinations thereof. It is therefore intended that the following appended claims and claims hereinafter introduced are interpreted to include all such modifications, permutations, additions and subcombinations that are within their true spirit and scope.

The invention claimed is:

1. A decorative panel for installation on a ceiling or wall as part of a grid of said panels, each said panel comprising:

a formed sheet of thin sheet metal or plastic material having a main decorative portion and side edges forming a perimeter of said panel;

said main decorative portion having an alignment cavity extending around a perimeter thereof;

each of said side edges having a flange offset from and extending outwardly from said main decorative portion and a groove positioned between said main decorative portion and said flange and extending inwardly with respect to said main decorative portion;

each said flange in said grid capable of overlapping a next adjacent said flange, each of said overlapping flanges receiving a fastener therethrough to retain each said panel against the ceiling or wall and defining a gap between adjacent said side edges of adjacent said panels with said grooves forming an opposing pair facing into and defining side walls of said gap;

a resilient concealment strip having a π-shaped section and being similar in length to each of said side edges and having flexible sides which resiliently engage into said grooves to secure said strip in said gap to conceal said fasteners, said π-shaped section having outwardly extending flanges which align with and fit into said alignment cavities of adjacent said panels.

2. A decorative panel for installation on a ceiling or wall as part of a grid of said panels, each said panel comprising:

a formed sheet of thin sheet metal or plastic material having a rectangular main decorative portion and side edges forming a perimeter of said panel;

said main decorative portion having an alignment cavity extending around a perimeter thereof;

each of said side edges having a flange offset and extending outwardly from said main decorative portion and a groove formed into said side edge between said main decorative portion and said flange and extending inwardly with respect to said main decorative portion;

each said flange having an aperture formed therethrough for receiving a fastener to retain each said panel against the ceiling or wall;

a resilient concealment strip similar in length to each of said side edges and having flexible sides which resiliently engage into said grooves of a gap formed between adjacent side panels of the grid to conceal said fasteners, said strip also including outwardly extending flanges which align with and fit into said alignment cavities of adjacent, connected said panels.

3. A decorative panel for installation on a ceiling or wall as part of a grid of said panels, each said panel comprising:

a formed sheet of thin sheet metal or plastic material having a rectangular main decorative portion and side edges forming a perimeter of said panel;

an alignment cavity extending around a perimeter of said main decorative portion;

each of said side edges having a flange offset from and extending outwardly from and in a plane substantially parallel to said main decorative portion and a groove positioned between said main decorative portion and each of said flanges and extending inwardly with respect to said main decorative portion;

each said flange in said grid overlapping a next adjacent flange, each of said overlapping flanges receiving a fastener therethrough to retain said grid against the ceiling or wall and defining a gap between adjacent side edges of adjacent said panels, with said grooves forming an opposing pair facing into said gap;

a resilient concealment strip having a generally π-shaped section and being similar in length to one said side edge and having flexible sides with laterally extending beads formed thereon which resiliently engage into said grooves to secure said strip in said gap to conceal said fasteners, said π-shaped section also having outwardly extending flanges which align with and fit into said alignment cavities of adjacent said panels, each of said beads having a chamfered leading surface which facilitates inward flexure of said sides as said strip is inserted into said gap.

* * * * *